US006203231B1

(12) United States Patent
Salice

(10) Patent No.: US 6,203,231 B1
(45) Date of Patent: Mar. 20, 2001

(54) FASTENING PLATE FOR A METAL FITTING MEANS, PREFERABLY TO FASTEN A HINGE ARM TO A SUPPORTING WALL OF A PIECE OF FURNITURE

(75) Inventor: Luciano Salice, Carimate (IT)

(73) Assignee: Arturo Salice S.p.A., Novedrate (IT)

( * ) Notice: Subject to any disclaimer, the term of this patent is extended or adjusted under 35 U.S.C. 154(b) by 0 days.

(21) Appl. No.: 09/085,857

(22) Filed: May 27, 1998

(30) Foreign Application Priority Data

Jul. 30, 1997 (DE) ..... 297 13 594

(51) Int. Cl.[7] ..... E05D 7/04

(52) U.S. Cl. ..... 403/12; 16/237; 16/382; 16/DIG. 43; 411/546

(58) Field of Search ..... 16/237, 238, 382, 16/DIG. 43; 403/11, 12, 343, 408.1; 411/546, 547; 52/243.1

(56) References Cited

U.S. PATENT DOCUMENTS

| | | | | |
|---|---|---|---|---|
| 4,642,846 | * | 2/1987 | Lautenschlager | 16/238 X |
| 4,768,259 | * | 9/1988 | Rock et al. | 16/382 |
| 4,862,556 | * | 9/1989 | Grass | 16/382 |
| 4,881,297 | * | 11/1989 | Grass | 16/DIG. 43 |
| 5,561,888 | * | 10/1996 | Lautenschlager | 16/382 X |
| 5,709,513 | * | 1/1998 | Tsai | 411/546 X |
| 5,906,080 | * | 5/1999 | DiGirolamo et al. | 411/546 X |
| 5,918,321 | * | 7/1999 | Olle | 16/DIG. 43 |
| 5,966,779 | | 10/1999 | Salice . | |

FOREIGN PATENT DOCUMENTS

| | | |
|---|---|---|
| 2714082 | 3/1977 | (DE) . |
| 2751459 | 6/1978 | (DE) . |
| 3717376 | 1/1988 | (DE) . |
| 3501048 | 5/1988 | (DE) . |
| 3841933 | 3/1991 | (DE) . |

* cited by examiner

*Primary Examiner*—Anthony Knight
*Assistant Examiner*—Greg Binda
(74) *Attorney, Agent, or Firm*—Ostrolenk, Faber, Gerb & Soffen, LLP

(57) ABSTRACT

A fastening plate for fastening a hinge arm to a supporting wall of a piece of furniture includes two oblong holes on an common centerline through which fastening screws engage. One fastening screw is supported with its head on a spacer element having a height greater than that of the fastening plate, and another fastening screw braces the fastening plate against the supporting wall. The height of the spacer element is greater than that of the fastening plate so that a slight amount of play is provided between the head of the fastening screw supported on the spacer element and the surface of the fastening plate, so that the fastening plate can be moved for adjustment while any undesired lifting of the fastening plate is prevented.

18 Claims, 8 Drawing Sheets

FASTENING PLATE FOR A METAL FITTING MEANS, PREFERABLY TO FASTEN A HINGE ARM TO A SUPPORTING WALL OF A PIECE OF FURNITURE

BACKGROUND OF TBE INVENTION

1. Field of the Invention

The invention relates to a fastening assembly for a metal fitting means, preferably to fasten a hinge arm to a supporting wall of a piece of furniture, having a fastening plate which for adjustment purposes is provided with two oblong holes on a common centreline through which fastening screws engage, wherein one fastening screw is supported with its head on a spacer means whose height is greater than that of the fastening plate, and wherein another fastening screw braces the fastening plate against the supporting wall or similar.

2. Brief Description of the Related Art

A fastening plate of this type is known from DE 35 01 048 C2 and consists of a bottom portion in the shape of a cross and plate with an elongated centre section which is provided with lateral wing-like attachments with the bottom portion being covered by a correspondingly designed top portion, oblong holes being provided in the wing-like attachments of the top portion and with the spacer means comprising a shaft-like protrusion which penetrates an oblong hole of the top portion in such a way that some slight axial play remains between the head of a screw screwed into the shaft-like protrusion and the top plate so that the top plate can be moved in the direction of the two oblong holes relatively to the bottom plate for the purpose of adjustment in one direction. To secure the position set, the top plate is braced with the bottom plate by means of the fastening screw penetrating the other oblong hole. The known fastening plate is relatively complex as it is designed in two parts and comprises a T-shaped bottom plate which is completely covered by a correspondingly designed top plate.

SUMMARY OF THE INVENTION

It is therefore the object of the invention to provide a more simply designed fastening assembly of the type first described which can be manufactured with less effort and more economically.

This object is achieved in accordance with the invention by the spacer means comprising a frame provided with a borehole, by the frame having a width corresponding to the oblong hole and being provided with lateral lugs overlapping the edges of the oblong hole and by the height of the frame between its bottom side and the bottom side of the lugs being greater than the height of the fastening plate.

In the fastening plate in accordance with the invention, its movability over the length of the oblong holes for the purpose of adjustment is ensured by the fact that one oblong hole is guided directly on the fastening screw which braces the fastening plate to a supporting wall or similar and that the other oblong hole is guided on the frame which equally takes on the function of a pressure guide. The frame forming the pressure guide is characterised by a small size so that it can be manufactured relatively simply with a low material requirement from die cast zinc (Zamak®) or as a sheet metal part. As the frame abuts the side edges of an oblong hole with its sides, it takes over the guidance of the fastening plate during any required adjustment movement. As the fastening plate possesses only a little play between the bottom side of the lugs of the frame and the supporting or fastening wall, a movement is ensured, on the one hand, for the purpose of adjustment and, on the other hand, any undesired lifting of the fastening plate is prevented.

In accordance with another embodiment of the invention, the object is solved by the spacer means comprising a frame being provided with a borehole, by the frame having a width corresponding to the oblong hole and by the head of the fastening screw penetrating the borehole of the frame overlapping the edges of the oblong hole play. In this embodiment of the invention, the fastening plate possesses such great play between the head of the fastening screw and the supporting wall that the fastening plate can be moved for the purpose of its adjustment. However, any undesired lifting of the fastening plate is prevented by the head of the fastening screw overlapping the edges of the oblong hole.

Appropriately, the frame is provided with a broadened edge section on its bottom side. This broadened edge section forms a support leg so that the frame does not press on the area of the edge of the borehole for the fastening screw in the supporting wall or similar with too great a surface pressure when the fastening screw overlapping it with its head is tightened. The broadened edge sections can consist of angular feet pointing away from each other which point in the direction of the oblong hole.

In another embodiment of the invention, it is provided that the shaft of the frame is provided with recesses on the long sides of the edges of the oblong hole and that the distance of the parallel planes limiting the outer sides of the recesses is smaller than the diameter of the thread section of the fastening screws. In this way, it is possible to pre-mount the fastening screws in such a way that these are partially screwed into the fastening plate so that for their mounting during transportation and assembly they cut into the edges of the oblong holes with their threads.

To ensure that the fastening plate can still be adjusted for the purpose of its adjustment with the fastening screws screwed in or almost screwed in, the fastening screws appropriately possess a thread diameter which is greater than the width of the oblong holes with a thread-free section being located between the heads of the fastening screws and their thread sections with a diameter which is smaller than the width of the oblong holes.

In their centre section, the oblong holes can be provided with increases of breadth in which the threads of the fastening screws cut for their mounting.

Fastening plates with oblong holes providing an adjustment capability, the centre section of which has oblong holes in which fastening screws are screwed for the purpose of mounting and pre-assembly. The fastening screws are provided with thread-free sections between their heads and their thread sections known from DE-OS 27 51 459.

In accordance with another embodiment, it is provided that the edges of the oblong hole overlapped by the lugs are positioned in a hollow of the fastening plate, that the head of the fastening screw overlaps the edges of the hollow with play and that play exists between the lugs and the hollow.

The hollows for the edge areas of the oblong hole can be formed by an edge step.

If the fastening plate is movable in the direction of the centreline of the oblong holes in accordance with the second embodiment of the invention, and if the fastening plate is secured in this position against any lifting from the support wall only by the head of the fastening screw overlapping the edges of the oblong hole penetrated by the fame, the fame can be provided with a foot winch is broadened like a flange and consisting of a circumferential edge, because in this embodiment, the frame and its shaft portion, which corresponds to the width of the oblong hole, can be inserted into the oblong hole before the fastening screw which is supported on the frame is screwed in.

BRIEF DESCRIPTION OF THE DRAWINGS

Embodiments of the invention are described below in detail by means of the drawings, in which.

DETAILED DESCRIPTION OF THE PREFERRED EMBODIMENTS

Figure 1:
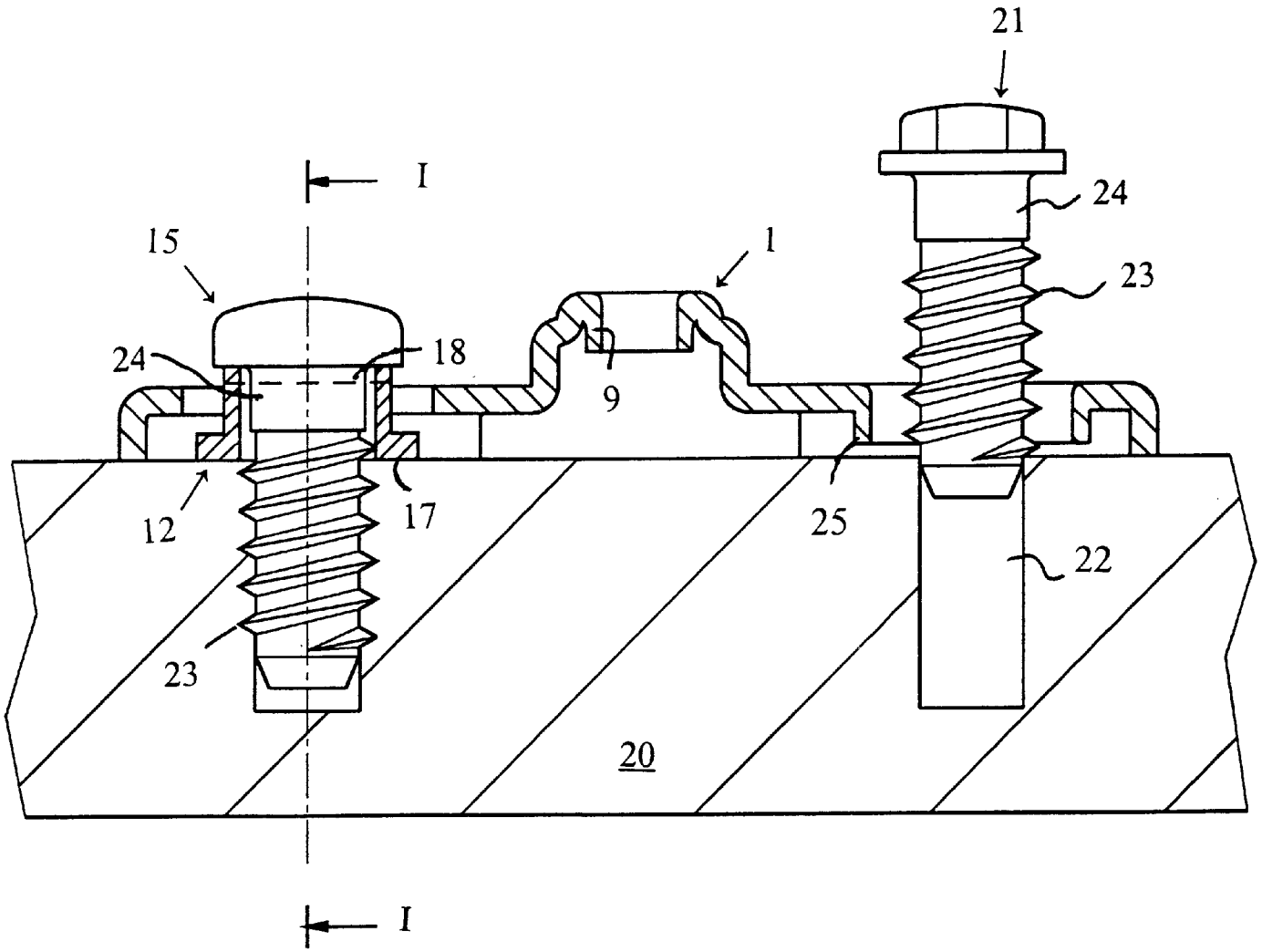
FIG. 1 shows a cross-section through the fastening plate which is located in its assembly position on a supporting wall.
Figure 2:
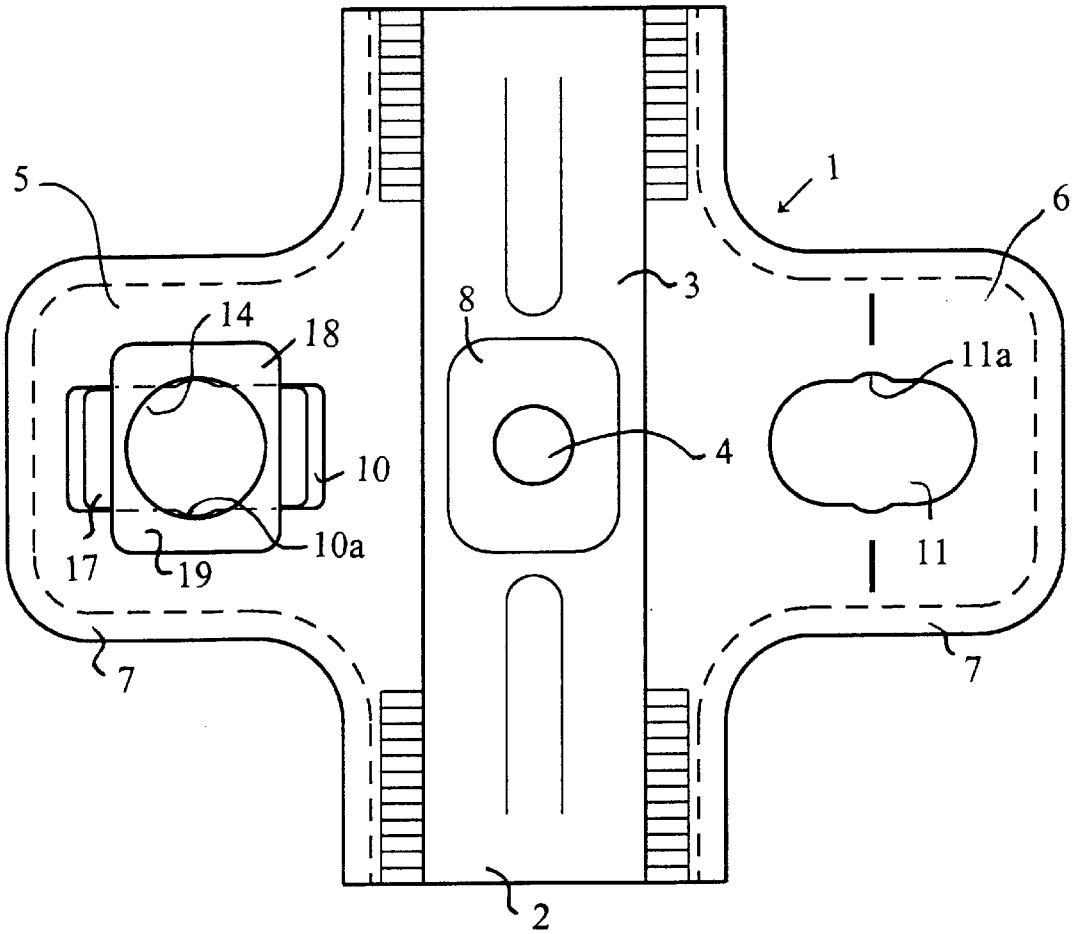
FIG. 2 shows a top view of the fastening plate of FIG. 1.

As shown in FIG. 2, the fastening plate 1 consists of an elongated, roughly rectangular centre portion 2 which is provided with a central, also roughly rectangular elevation 3 with a U-shaped section whose width is adapted to correspond with the width of a U-shaped sectioned hinge arm of a furniture hinge so that this can be fastened in a conventional manner by a fastening screw which is positioned in a taphole 4 in the centre section of the elevation 3. The fastening plate is provided with lateral wing-like protrusions 5, 6 which are attached laterally to the centre section of the elongated portion 2. The fastening plate consists of a stamped metal sheet and is provided with a flanged edge 7 which extends around the wing-like protrusions and along the connected side areas of the centre portion 2. The taphole 4, which is located in a base-like elevation 8 on the elevation 3, is also provided with a flanged edge 9 (FIG. 1).

The wing-like protrusions 5, 6 are provided with oblong holes 10, 11 which lie on a common centreline.

Figure 1A:
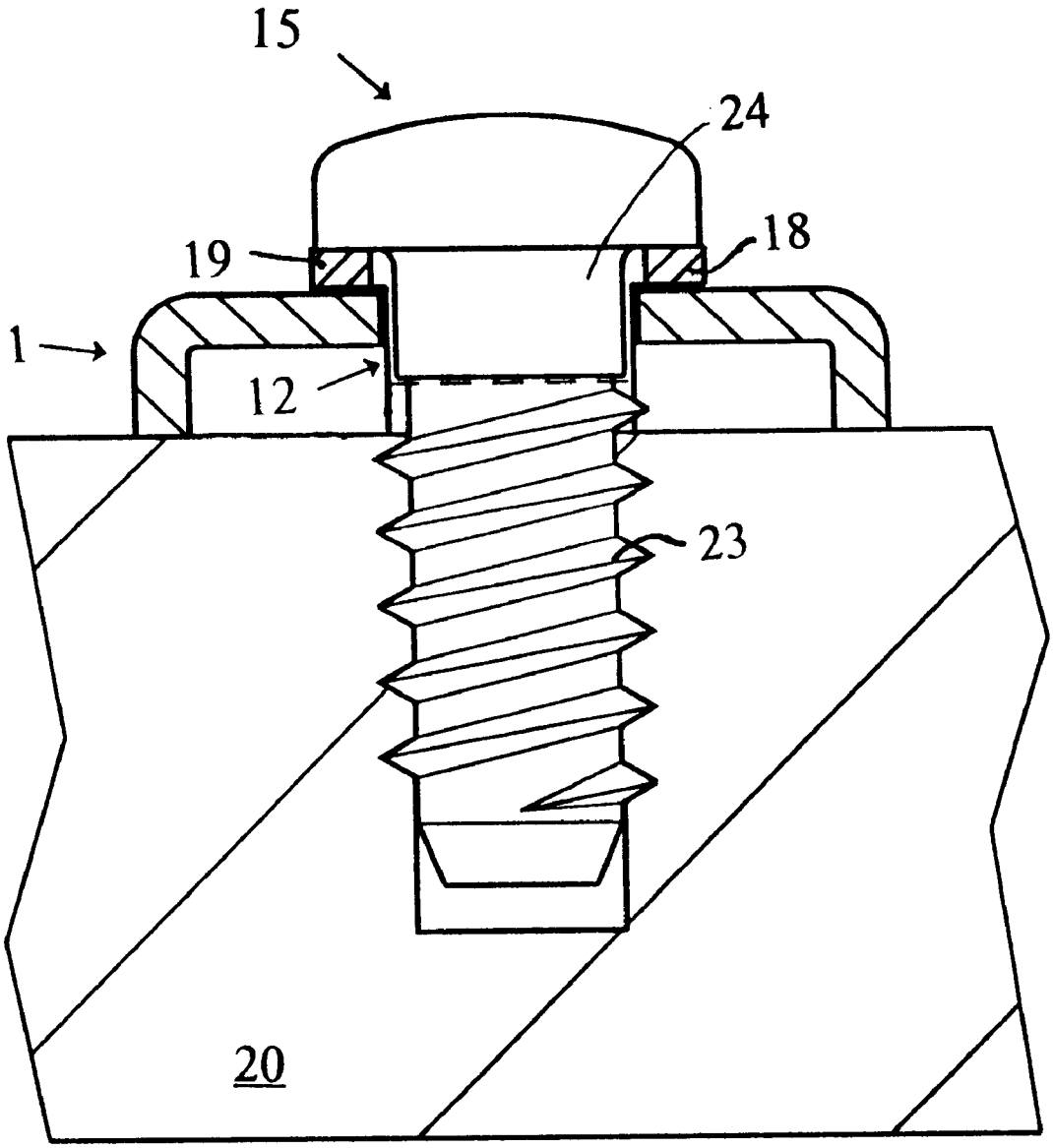
FIG. 1A shows a cross-section through the fastening plate as indicated at I—I in FIG. 1.

The frame 12 forming a pressure guide is inserted in the substantially rectangular oblong hole 10. The frame 12 consists of a central, essentially rectangular shaft portion 13 with straight outer sides. The frame 12 is provided with a central through-hole 14 which receives a fastening screw 15. The width of the frame 12 corresponds in the manner visible from FIG. 2 to the width of the oblong hole 10 in such a way that its sides 16*a* which are parallel to one another (of which only one side is visible in FIG. 3) form slide guides for the long edges of the oblong hole 10. The bore hole 14 cut into the sides 16*a* to form gaps through which the thread sections of a fastening screw engaged in the bore hole 14 penetrate the sides 16*a*. Abutting the sides 16*b* which are parallel to one another, the frame 12 is provided with angular support legs 17 which each point outwards and whose width also corresponds to the width of the oblong hole 10 so that the frame 12 can be inserted from above into the oblong hole 10. The shaft portion 13 of the frame 12 bears an upper flange-like edge with lugs 18, 19 for overlapping opposite long edges of the oblong hole 10 (FIGS. 1A, 2). The height of the frame 12 from the bottom of the supporting legs 17 to the bottom surface of the lugs 18, 19 is slightly greater than the height of the fastening plate 1 from the bottom supporting surface of the flanged edges 7 up to its top surface around oblong hole 10. Constructed in this manner, when the fastening screw 15 is screwed in, the fastening plate 1 is fixed on the supporting wall 20 so that the fastening plate 1 can no longer be lifted, but it can still be moved in the direction of the centrelines of the oblong holes 10, 11.

Figure 4:
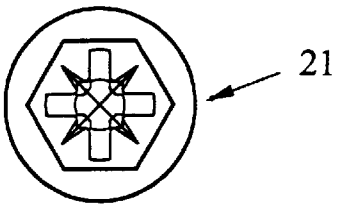
FIG. 4 shows a top view of a fastening screw.

The fastening screw 21 (FIG. 4) engages through the oblong hole 11 in the wing-like protrusion 6, so that the fastening screw 21 is screwed into the blind hole 22 of the support wall 20 to fix the fastening plate 1 in position.

The fastening screws 15, 21 possess bottom, self-tapping thread sections 23 and sections 24 without thread between the respective thread section and head. The diameters of the sections 24 without thread bit within to the width of the oblong holes 10, 11. The oblong holes 10, 11 possess in their centre areas opposite-lying convexities 10*a*, 11*a* which facilitate the pre-mounting of the fastening screws. For the better retaining the pre-mounted screw 21, the oblong hole 11 is provided with a flange 25 visible from FIG. 1.

Figure 7:
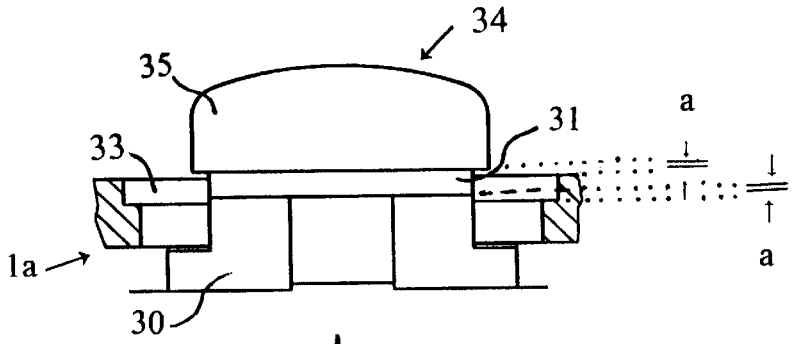
FIG. 7 shows an enlarged representation of the circled part of FIG. 6.
Figure 6:
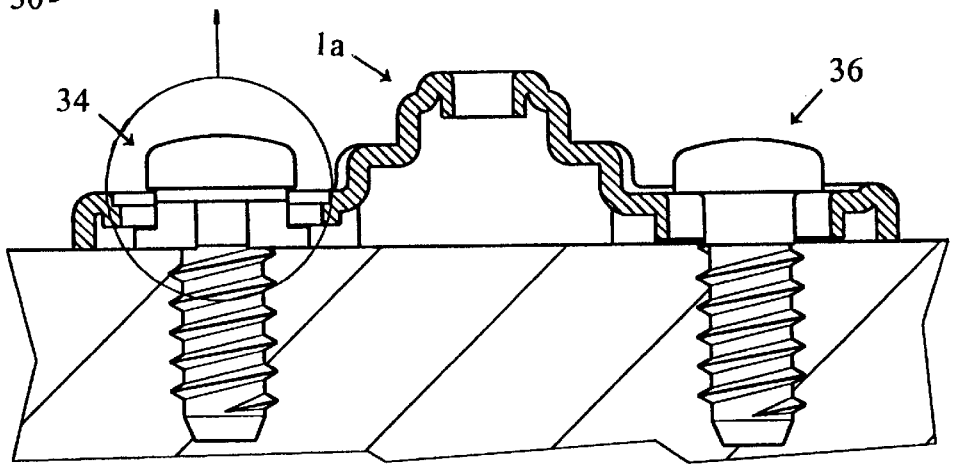
FIG. 6 shows a section through the fastening plate of FIG. 5.
Figure 5:
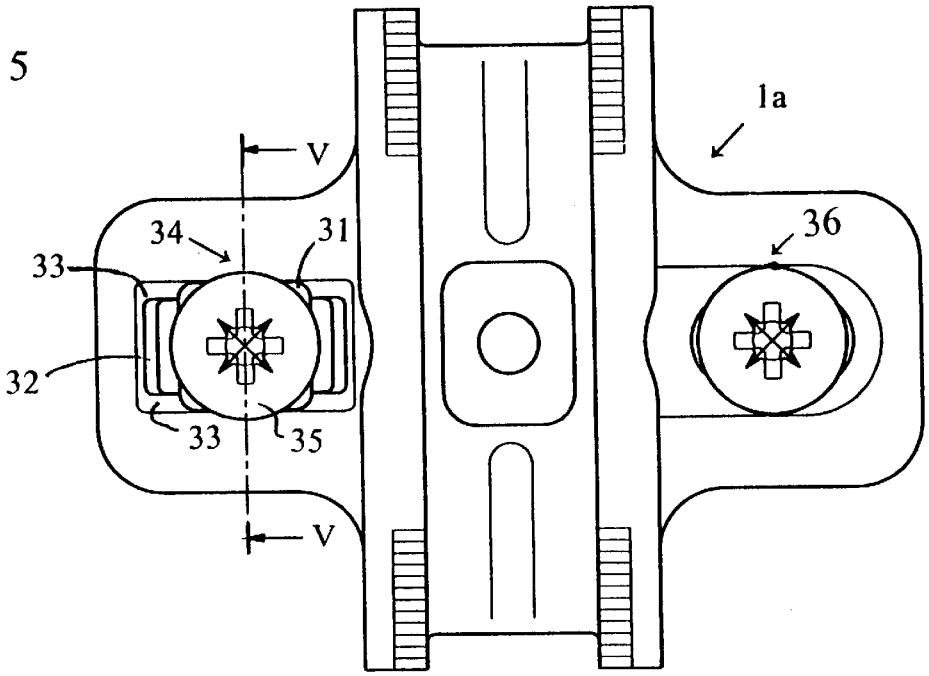
FIG. 5 shows a top view of a second embodiment of a fastening plate.
Figure 5A:
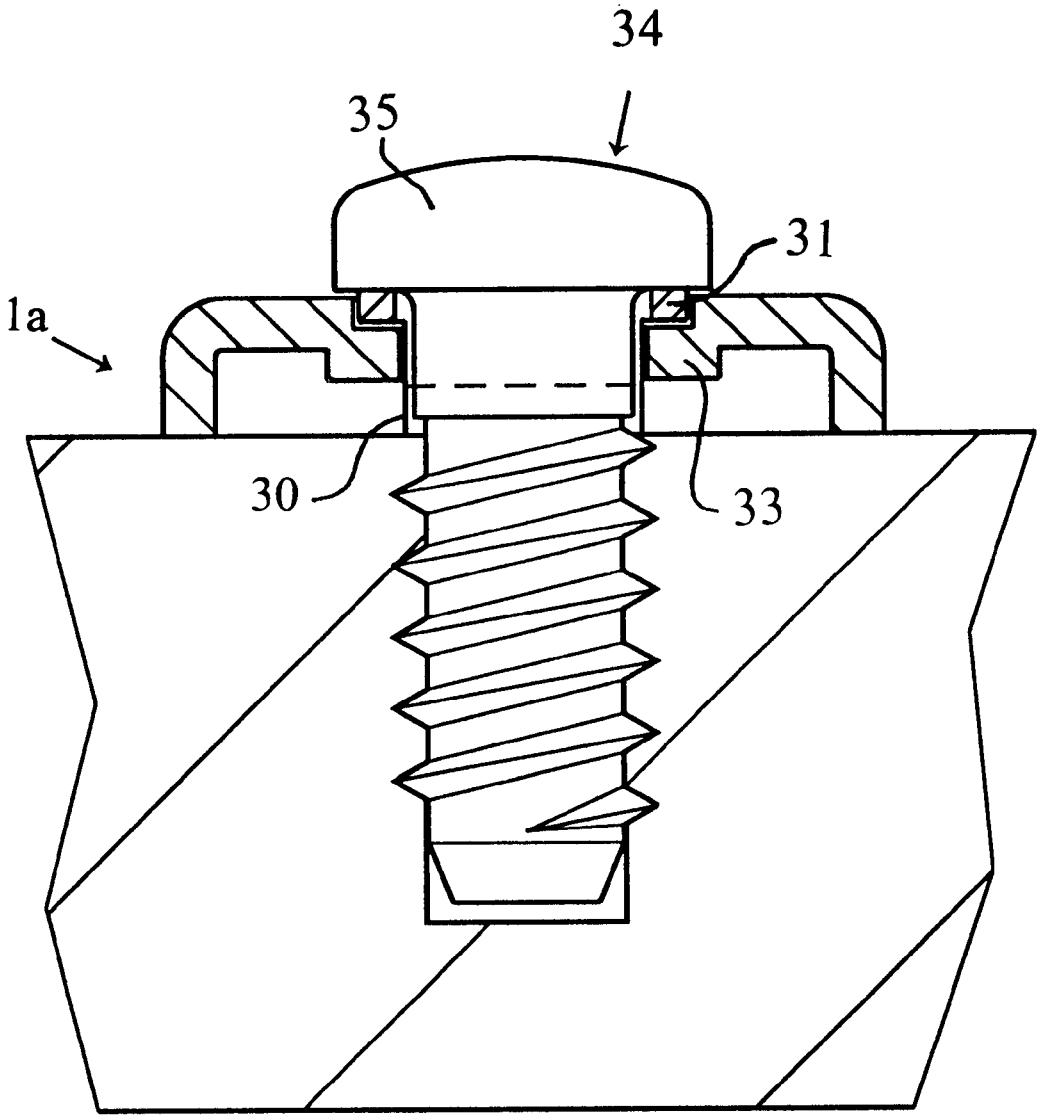
FIG. 5A shows a cross-section through the fastening plate as indicated at V—V in FIG. 5.

In the embodiment of the fastening plate from FIGS. 5 to 7, the frame 30 forming the pressure guide is provided with lateral lugs 31 which overlap the long, lateral edges of the oblong hole 32 in step-shaped hollow 33. The central borehole of the frame 30 is penetrated by a fastening screw 34 whose broadened head 35 overlaps the edges of the stepshaped hollow 33.

Between the bottom surface of the head 35 of the fastening screw 34 and the edges of the hollow 33 and between the lugs 31 and the edges of the oblong hole lying in the hollow, slight areas of play "a" are provided so that the fastening plate 1 is secured against lifting and so that it can nevertheless be moved in the direction of the oblong holes for adjustment before the fastening screw 36 is tightened.

Figure 3:
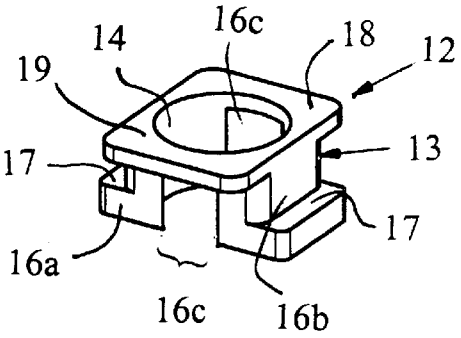
FIG. 3 shows a perspective view of the pressure guide.
Figure 8:
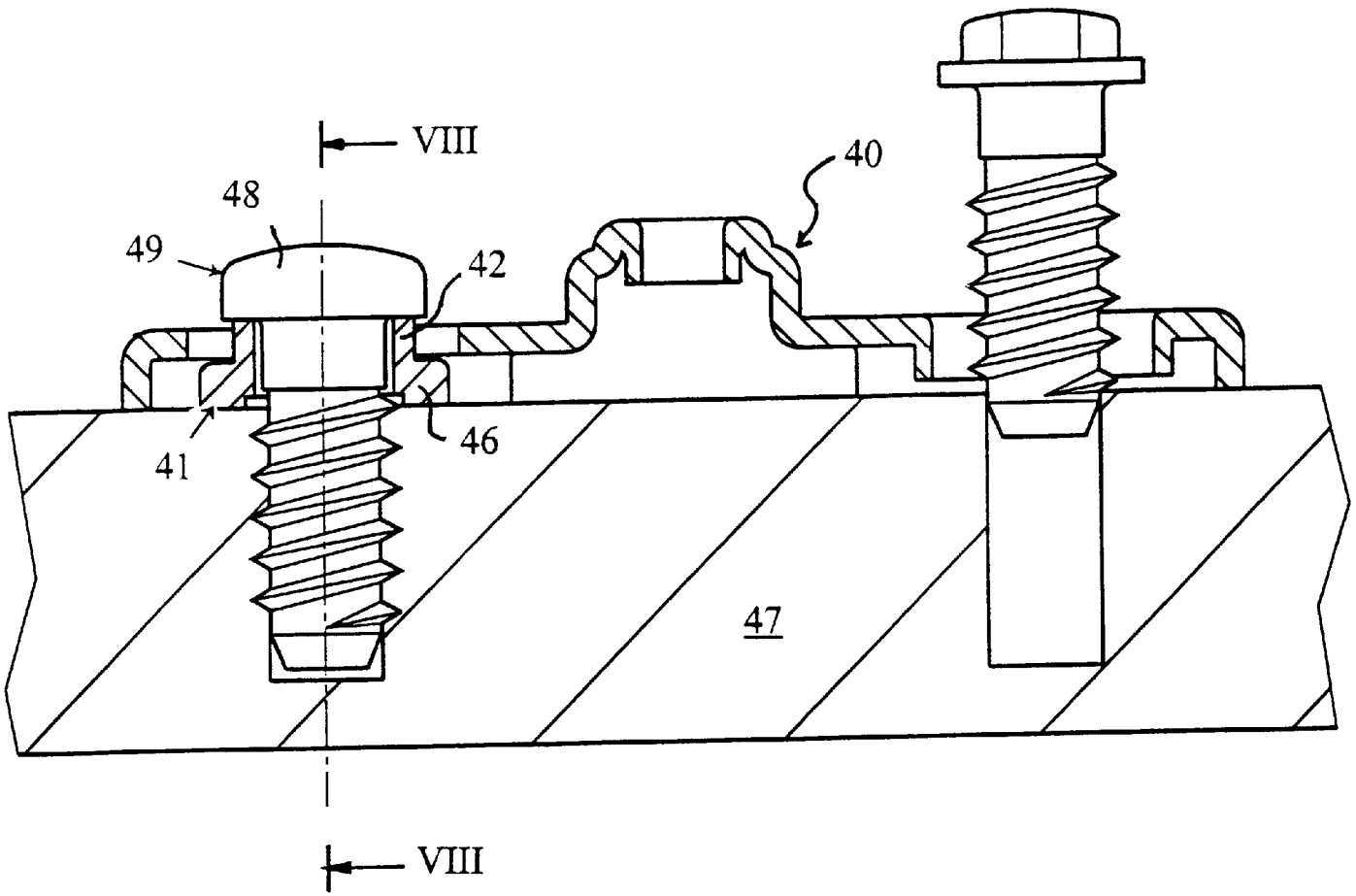
FIG. 8 shows a cross-section through a third embodiment of a fastening plate.
Figure 8A:
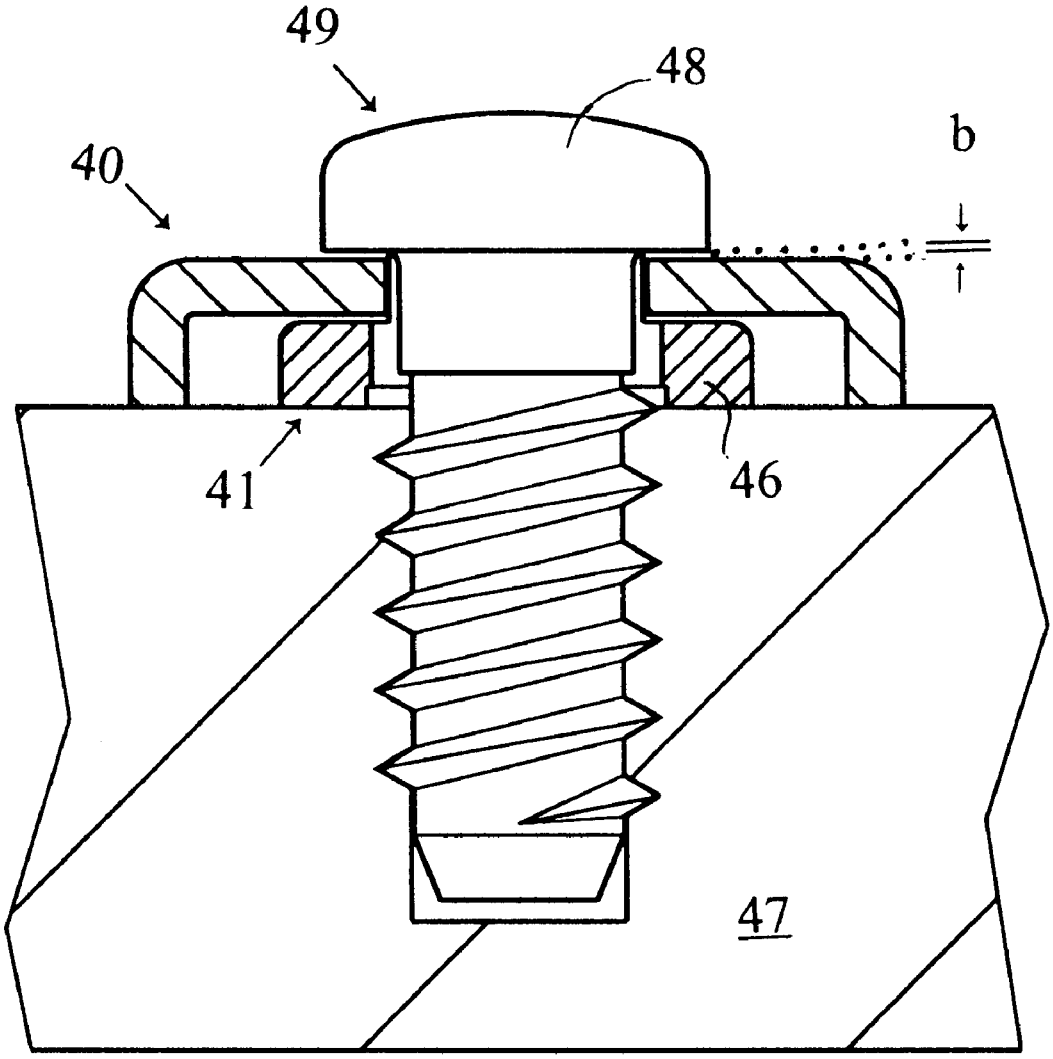
FIG. 8A shows a cross-section through the fastening plate as indicated at VIII—VIII in FIG. 8.
Figure 9:
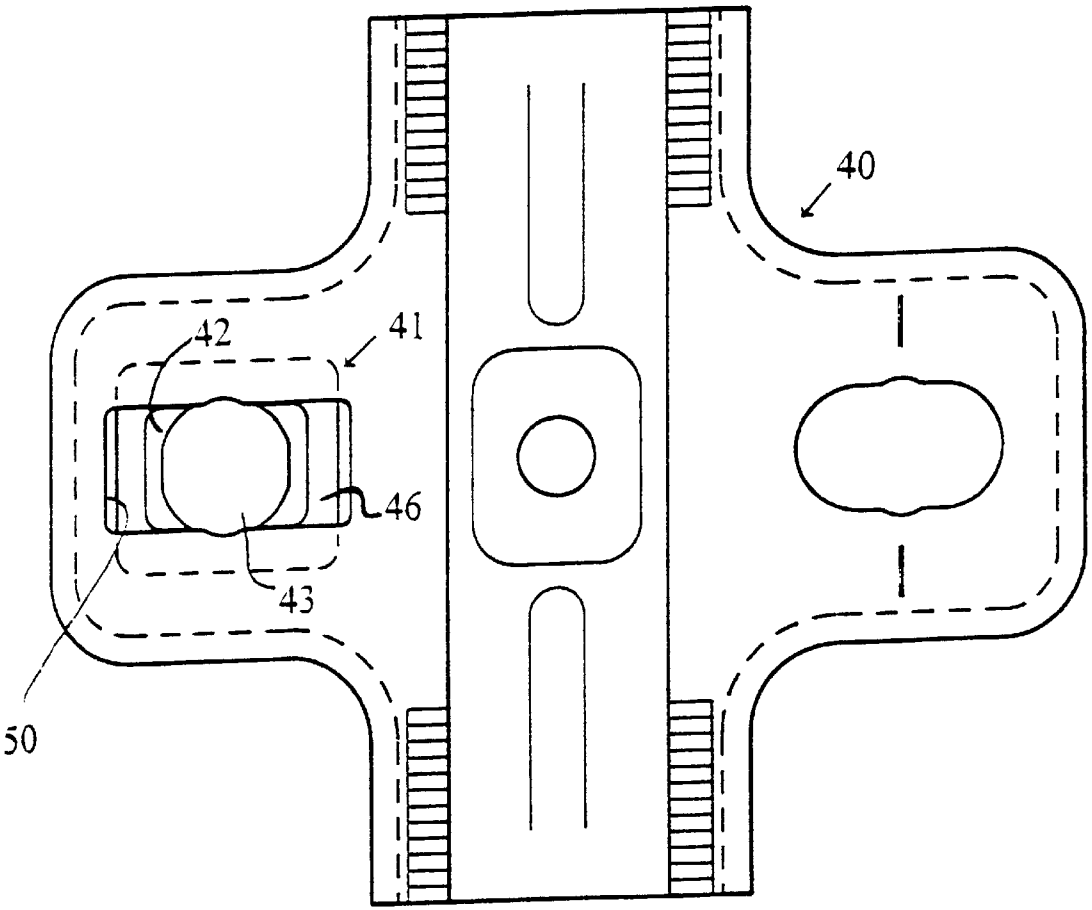
FIG. 9 shows a top view of the fastening plate of FIG. 8.

The fastening plate 40 in FIGS. 8, 8A and 9 possesses the same design as the fastening plate from FIGS. 1 and 3, so it is not described again here.

Figure 10:
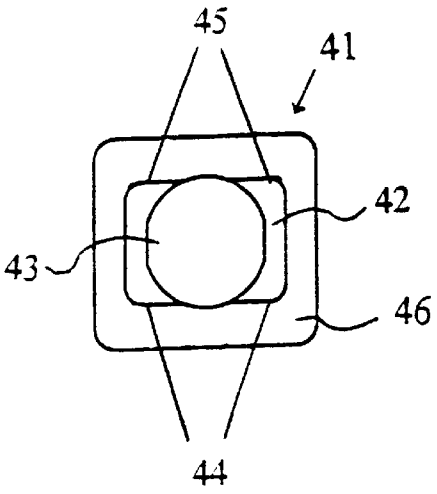
FIG. 10 shows a top view of the pressure guide for guidance of the fastening plate of FIGS. 8 and 9.

In contrast to the embodiment in accordance with FIGS. 1 to 4, however, the fastening plate 40 is mounted with a differently designed frame 41 which forms the pressure guide. The frame 41 consists of an essentially rectangular shaft portion 42 which is provided with a central through-hole 43 which cuts on the long side walls 44, 45 of the shalt portion 42 in the manner visible from FIG. 10 in their central areas.

The shaft portion 42 is provided with a lower, flange-like rectangular edge 46 which forms a broadened leg for support on the supporting wall 47.

As seen in FIGS. 8 and 8A, the height of the frame 41 from the bottom surface of the supporting leg 46 up to its top surface is slightly greater than the height of the fastening plate 40 in the vicinity of the oblong hole 50, so that the head 48 of the fastening screw 49 overlaps the lateral edges of the oblong hole 50 with play b.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A fastening assembly for affixing a fitting structure to a support structure, comprising:

a fastening plate having a bottom side for contacting the support structure, the fastening plate including two oblong holes through which a pair of fastening screws may be inserted, each oblong hole having two opposing long edges, a distance between the two opposing long sides defining a width of the oblong hole; and a spacer frame having a height greater than that of the fastening plate at the vicinity of the oblong holes for extending through one of the oblong holes, the spacer frame having a shaft extending from a borehole at a top-most surface thereof to a bottom-most surface thereof for receiving one of the fastening screws, wherein the bottom of the shaft has broadened edge portions for contacting the support structure, such that when the spacer frame extends through one of the oblong holes and the fastening plate is affixed to the support structure, both the bottom side of the fastening plate and the bottom-most surface of the spacer frame are placed on the support structure.

2. A fastening assembly in accordance with claim 1, wherein the spacer frame has a width corresponding to that of the oblong hole, further comprising a fastening screw including a head having a diameter greater than the width of the oblong hole, such that when the fastening screw is received in the borehole of the frame, the head overlaps the edges of the oblong hole with play.

3. A fastening assembly in accordance with claim 1, wherein the broadened edge portions comprise angular feet pointing in different directions along the oblong hole.

4. A fastening assembly in accordance with claim 1, further comprising a fastening screw having a threaded section, wherein the shaft of the spacer frame is provided with gaps sides thereof that engage the opposing long edges of the oblong hole and wherein the distance between the sides having the gaps is smaller than an outer diameter of the threaded section of the fastening screw.

5. A fastening assembly in accordance with claim 1 further comprising at least one fastening screw each having a threaded section and a non-threaded section, wherein the threaded section has a diameter which is greater than the width of the oblong holes and wherein the non-threaded sections have a diameter which is smaller than the width of the oblong holes.

6. A fastening assembly in accordance with claim 1, wherein the width of at least one of the oblong holes widens at a center portion thereof.

7. A fastening assembly in accordance with claim 1, wherein the top surface of the spacer frame on which the borehole is provided includes lateral lugs having a width greater than that of the oblong holes, such that when the spacer frame extends through one of the oblong holes, the lateral lugs overlap the long edges of the oblong hole. and wherein a distance from the bottom-most surface of the spacer frame to a bottom surface of the lateral lugs is greater than the height of the fastening plate at the vicinity of the oblong hole to provide an area of play between the bottom surface of the lateral lugs and a top surface of the fastening plate.

8. A fastening assembly in accordance with claim 7, wherein the fastening plate further includes a hollow extending along the periphery of one of the oblong holes, such that when the spacer frame extends through oblong hole having the hollow, the lateral lugs lie in the hollow.

9. A fastening assembly in accordance with claim 8, further comprising a fastening screw having a head, such that when the spacer frame extends through oblong hole having the hollow, the lateral lugs lie in the hollow with play and the head of the fastening screw overlaps the hollow with play.

10. A fastening assembly in accordance with claim 8, wherein the hollow is formed by an edge step.

11. A fastening assembly in accordance with claim 1, wherein the broadened edge portions of the spacer frame is formed as a flange extending around the peripery of the bottom of the spacer frame for contacting the bottom side of the fastening plate at the vicinity of the long edges of one of the oblong holes.

12. A fastener assembly in accordance with claim 1, wherein the oblong holes are oriented so as to have a common center line in the longitudinal direction.

13. A fastening assembly for affixing a metal fitting to a support structure, comprising:

a fastening plate having a bottom side for contacting the support structure and a shaped portion for receiving the metal fitting, the fastening plate including two oblong holes through which a pair of fastening screws may be inserted; and a spacer frame having a height greater than that of the fastening plate in the vicinity of the oblong holes for extending through one of the oblong holes, the spacer frame having a shaft extending from a borehole at a top-most surface thereof to a bottom-most surface thereof for receiving one of the fastening screws, such that when the spacer frame is placed with its bottom-most surface on the support structure and extending through one of the oblong holes, the metal fitting can be affixed to the support structure such that the fastening plate can be adjusted with play but is prevented from being lifted away from the support structure.

14. A fastening assembly according to claim 13, wherein the shaped portion is an elevated rectangular portion having a U-shaped section to receive a hinge arm of a furniture hinge.

15. A fastening assembly according to claim 14, wherein the elevated rectangular portion has a taphole for receiving a fastening screw to fasten the furniture hinge.

16. A fastening assembly according to claim 13, wherein the fastening plate is formed as a stamped metal sheet.

17. A fastener assembly according to claim 13, wherein the oblong holes are oriented so as to have a common center line in the longitudinal direction.

18. A fastener assembly according to claim 13, wherein the spacer frame is made of metal.

* * * * *